US010618020B2

(12) United States Patent
Rupp

(10) Patent No.: US 10,618,020 B2
(45) Date of Patent: Apr. 14, 2020

(54) APPARATUS, SYSTEM AND METHOD FOR MIXING FLUIDS USING A DRUM MIXER

(71) Applicant: Snowie LLC, Salt Lake City, UT (US)

(72) Inventor: Carl A. Rupp, Salt Lake City, UT (US)

(73) Assignee: Snowie LLC, Salt Lake City, UT (US)

( * ) Notice: Subject to any disclaimer, the term of this patent is extended or adjusted under 35 U.S.C. 154(b) by 425 days.

(21) Appl. No.: 14/668,847

(22) Filed: Mar. 25, 2015

(65) Prior Publication Data

US 2015/0272392 A1 Oct. 1, 2015

Related U.S. Application Data

(60) Provisional application No. 61/970,175, filed on Mar. 25, 2014.

(51) Int. Cl.

| | |
|---|---|
| ***B01F 13/00*** | (2006.01) |
| ***B01F 15/02*** | (2006.01) |
| ***B01F 15/00*** | (2006.01) |
| ***B01F 9/04*** | (2006.01) |

(52) U.S. Cl.
CPC ..... *B01F 13/0042* (2013.01); *B01F 9/04* (2013.01); *B01F 15/00506* (2013.01); *B01F 15/0295* (2013.01)

(58) Field of Classification Search
CPC ..... B01F 13/0042; B01F 7/027; B01F 9/04; B01F 9/0018; B01F 2009/0059; B01F 15/00506; B01F 15/0295
USPC ..... 366/135, 213–215, 185
See application file for complete search history.

(56) References Cited

U.S. PATENT DOCUMENTS

| | | | | | |
|---|---|---|---|---|---|
| 43,423 | A * | 7/1864 | Murphy | B01F 9/04 | 366/220 |
| 86,999 | A * | 2/1869 | Murphy | B01F 9/04 | 366/220 |
| 200,997 | A * | 3/1878 | Farmer | B01F 9/04 | 366/220 |
| 209,322 | A * | 10/1878 | Benedict | B01F 9/04 | 366/220 |
| 227,239 | A * | 5/1880 | Frentress | B01F 9/04 | 366/220 |
| 344,503 | A * | 6/1886 | Smith | B01F 9/04 | 366/220 |
| 379,447 | A * | 3/1888 | Chamberlain | B01F 9/0018 | 366/213 |

(Continued)

FOREIGN PATENT DOCUMENTS

| | | | | |
|---|---|---|---|---|
| EP | 0053781 | A1 * | 6/1982 | A22C 9/005 |
| GB | 1159261 | A * | 7/1969 | B01F 9/0005 |
| JP | 59203629 | A * | 11/1984 | B01F 9/0005 |

*Primary Examiner* — Marc C Howell
(74) *Attorney, Agent, or Firm* — Terrence J. Edwards; TechLaw Ventures, PLLC

(57) ABSTRACT

A mixer for mixing a fluid and for dispensing the fluid into another container is disclosed. The mixer includes a first container configured to receive and hold a fluid, a stand including a base portion and an upright portion, and a bracket configured to receive and support the first container. The upright portion of the stand extends vertically up from the base portion. The bracket includes two structural members connected by at least one cross bar. The bracket is rotatably attached to the stand via an axle to allow the first container to rotate relative to the stand.

21 Claims, 6 Drawing Sheets

(56) References Cited

U.S. PATENT DOCUMENTS

| | | | | | |
|---|---|---|---|---|---|
| 645,476 | A * | 3/1900 | Kingsley | B01F 9/04 | 366/220 |
| 797,318 | A * | 8/1905 | Raw | B01F 9/0018 | 248/141 |
| 1,018,508 | A * | 2/1912 | Lawler | B01F 9/04 | 366/220 |
| 1,018,947 | A * | 2/1912 | Wall | B01F 9/0018 | 248/141 |
| 1,026,259 | A * | 5/1912 | Fellows | B01F 9/04 | 366/220 |
| 1,077,547 | A * | 11/1913 | O'Hara | B01F 9/04 | 248/140 |
| 1,148,786 | A * | 8/1915 | McKenney et al. | B01F 9/04 | 366/209 |
| 1,301,536 | A * | 4/1919 | Bee | B01F 9/0018 | 248/141 |
| 1,917,119 | A * | 7/1933 | Holmquist | B01F 9/0005 | 366/213 |
| 4,106,118 | A * | 8/1978 | Hoover | B01F 7/162 | 241/97 |
| 4,123,176 | A * | 10/1978 | Barker | B01F 9/0018 | 366/213 |
| 2010/0068087 | A1* | 3/2010 | Saveker | B01F 3/18 | 419/10 |

* cited by examiner

APPARATUS, SYSTEM AND METHOD FOR MIXING FLUIDS USING A DRUM MIXER

CROSS-REFERENCE TO RELATED APPLICATIONS

This application claims the benefit of U.S. Provisional Application No. 61/970,175 filed Mar. 25, 2014, and is hereby incorporated by reference herein in its entirety, including but not limited to those portions that specifically appear hereinafter, the incorporation by reference being made with the following exception: In the event that any portion of the above-referenced provisional application is inconsistent with this application, this application supersedes said above-referenced provisional application.

STATEMENT REGARDING FEDERALLY SPONSORED RESEARCH OR DEVELOPMENT

Not Applicable.

BACKGROUND

The disclosure relates generally to fluid mixing devices, systems and methods, and more particularly, but not necessarily entirely, to a drum mixing device capable of mixing large amounts of fluids.

The fluid mixing devices, systems, and methods of the disclosure may be used in various capacities to mix a wide variety of fluids having a wide variety of viscosities. Thus, the disclosure is not limited to any particular type of fluid or viscosity. An example of fluids that may be mixed by the devices, systems, and methods of the disclosure include, but are not limited to, syrups and thickeners used for shaved ice confectioneries.

A variety of machines have been developed, described and are widely known for mixing fluids. However, despite the advantages of such machines, improvements are still being sought. Machines in the marketplace may have limitations such as, cumbersome procedures requiring a user to be heavily involved in the syrup making process requiring unnecessary human capital to mix the fluids. Such machines tend to cause slowness to the overall operation, which may be disadvantageous in industries where speed is required. For example, slow machines or machines that require large amounts of human capital to operate can reduce the efficiency of a business. In various industries, for example a shaved ice business or any other business in the concessions industry, it is important for the success of that business to move customers through a waiting line quickly to finalize the sale of a confectionary product to customers. In the example of a shaved ice business, the ability to quickly add or mix flavor syrups and provide the syrup required for patrons to use is imperative to the success of a shaved ice concession stand or business, especially in locations where time is of the essence, for example at a halftime break at a sporting event or other intermission. Otherwise, when mixing flavors or other fluids consumes too much time the business will lose out on the opportunity to make a sale because the break is either over or the customers are tired of waiting in long lines.

Machines in the marketplace may thus be characterized by several disadvantages that may be addressed by the disclosure. The disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims or examples used in the disclosure. Any discussion of documents, acts, materials, devices, articles or the like which has been included in the present specification is not to be taken as an admission that any or all of these matters form part of the prior art base, or were common general knowledge in the field relevant to the disclosure as it existed before the priority date of each claim of this application.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

The disclosure extends to devices, systems and methods for mixing fluids, such as a confectionary topping, and dispensing the fluids into another container. In the following description of the disclosure, reference is made to the accompanying drawings, which form a part hereof, and in which is shown by way of illustration specific implementations in which the disclosure may be practiced. It is understood that other implementations may be utilized and structural changes may be made without departing from the scope of the disclosure.

Before the apparatus, system and methods for mixing fluids in a container are disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular implementations only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

As used herein, the term "motor" refers to a power source that imparts torque; or any rotating pneumatic or air motor, which does mechanical work by expanding compressed air; or any electromagnetic device used to convert electrical energy into mechanical energy; whether or not the power source, motor or electromagnetic device is housed within or as part of another device.

As used herein, the term "proximal" shall refer broadly to the concept of a nearest portion.

As used herein, the term "distal" shall generally refer to the opposite of proximal, and thus to the concept of a further portion, or a furthest portion, depending upon the context.

Figure 1:
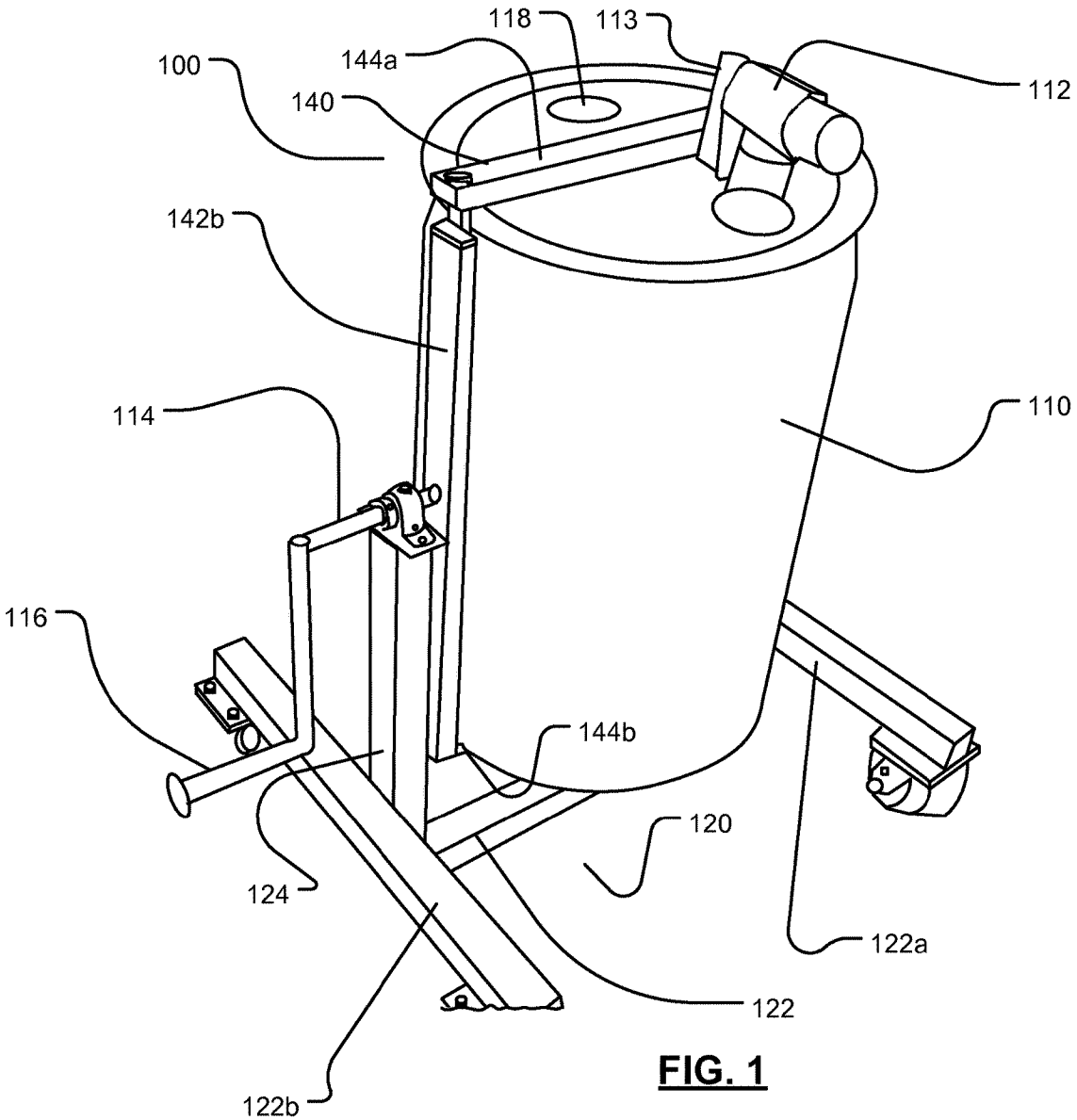
FIG. 1 illustrates a mixing device, system and method for mixing a fluid and dispensing the fluid into another container according to the teachings and principles of the disclosure.
Figure 2:
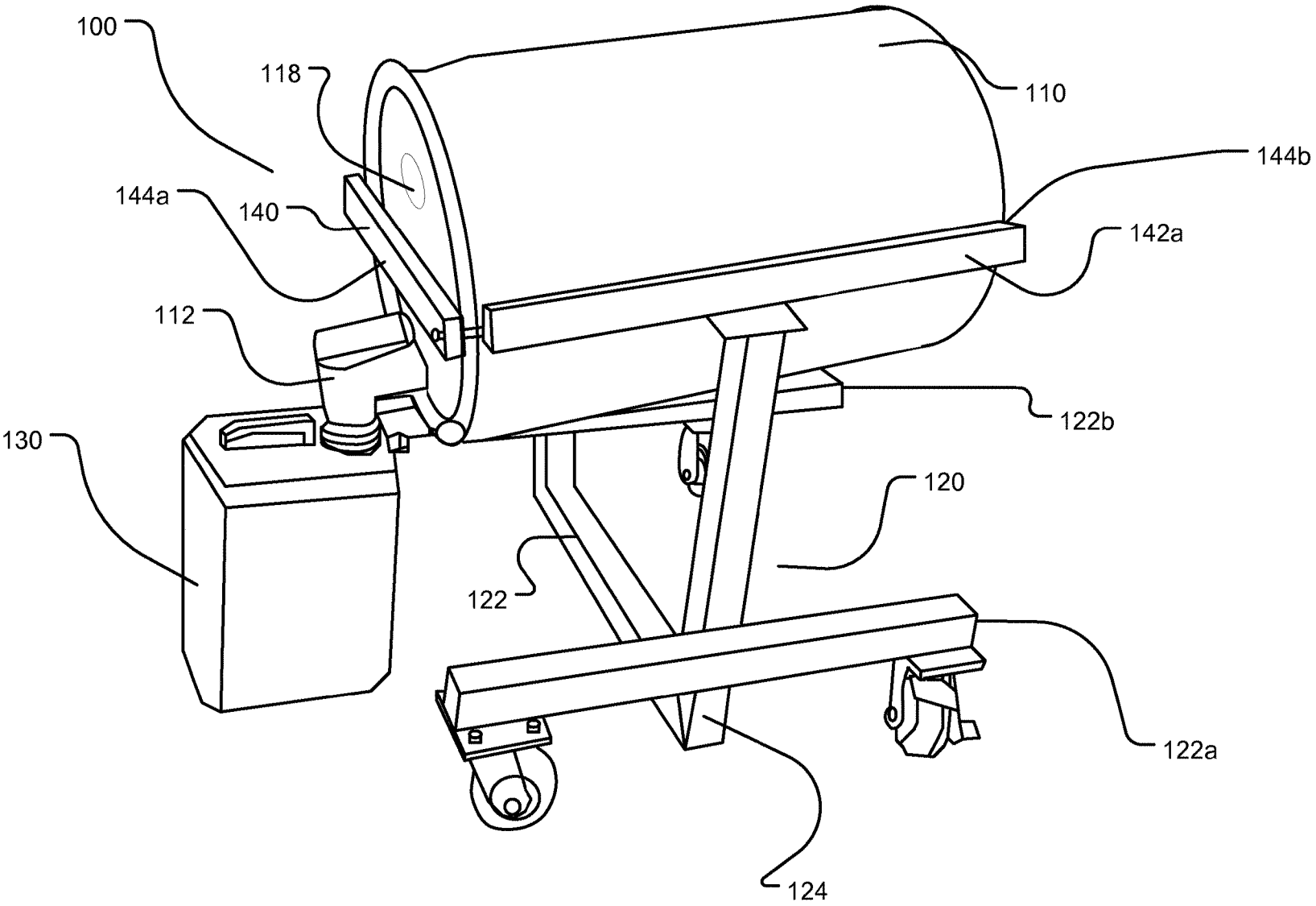
FIG. 2 illustrates a mixing device, system and method for mixing a fluid and dispensing the fluid into another container according to the teachings and principles of the disclosure.
Figure 3:
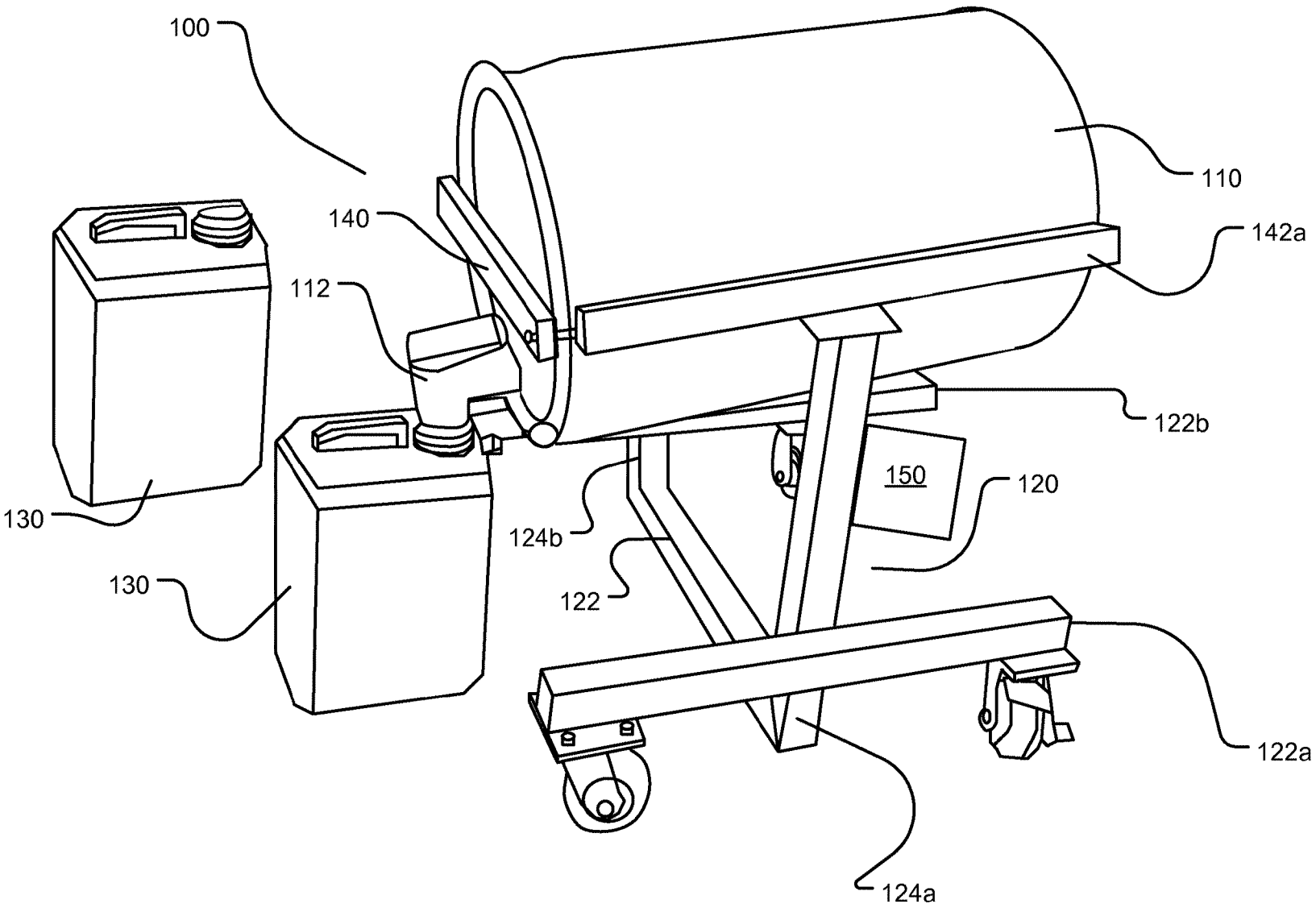
FIG. 3 illustrates a mixing device, system and method for mixing a fluid and dispensing the fluid into another container according to the teachings and principles of the disclosure.

Referring now to FIGS. 1-3, various implementations and components of a mixing device, system and method are illustrated. An implementation of a mixing device, system and method 100 for mixing a fluid and dispensing the fluid into another container may comprise a container 110 that may be configured to receive a fluid therein, such as a confectionary topping, which may be neutral or flavored confectionary topping. It will be appreciated that an implementation of the container 110 may be a drum that has a capacity to store or contain between about 5 U.S. gallons to about 55 U.S. gallons. For example, the container 110 may be a 5 gallon drum, a 10 gallon drum, a 15 gallon drum, a 20 gallon drum, a 25 gallon drum, a 30 gallon drum, a 35 gallon drum, a 40 gallon drum, a 45 gallon drum, a 50 gallon drum, or a 55 gallon drum. It should be noted that the container 110 may be any container that is suitable for the intended purpose of mixing a food grade fluid therein.

It will be appreciated that the fluid may include confectionary topping components that are to be mixed, such as liquids components, which may include water and flavoring syrups, and granular components, such as sugar.

As noted above, in an implementation the container 110 may be a drum or a barrel. Many drums have a common nominal volume, such as 55 US gallons (208 liters; 46 imp gal) and nominally measure just under 35 inches (880 millimeters) tall with a diameter just under 24 inches (610 millimeters) and differ by holding about thirteen gallons more than a Barrel of Crude Oil. In the United States, 25-US-gallon (95 l; 21 imp gal) drums are also in common use and have the same height. This allows easy stacking of mixed pallets. Barrels can be constructed of plastic, laminated paperboard or steel.

The two common sub-types of drums are the open top and the welded top (with 2-inch (51 mm) NPS bung holes). The latter are almost universally called "barrels" in preference to drums in the United States. They cannot efficaciously either dispense or be filled with powdered goods, though they might store them very well, so are not used for such goods, being reserved for liquids transport and storage. Plastic drums may be manufactured using injection blow molding technology and have either a separate lid (similar to those on fiber drums) or a welded type top with the bung holes molded therein. Metal drums may be manufactured with steel hot-rolled into long pipe-like sections then forged on a stamping press while still red-hot into drum bodies. A welded rolled seam may then be made for the drum bottom, or bottom and top both.

It will be appreciated that some drums have reinforcing rings of thickened metal or plastic at four places: top, bottom, and one each a third of the way from each end ring. This sufficiently strengthens them so that they can readily be turned on their sides and rolled when filled with heavy materials, like liquids. Over short to medium distances, drums can be tipped and rolled on the bottom rim while being held at an angle, balanced, and rotated with a two-handed top grip that also supplies the torque (rotational or rolling force).

The open-top sub-type may be sealed by a mechanical ring clamp (concave inwards) that exerts sufficient pressure to hold many non-volatile liquids and make an airtight seal against a gasket, as it exerts force inward and downward when tightened by a normal three-quarter inch wrench or ratchet wrench. Tops exist with bung holes as noted above, and these hybrid drums may contain a lid and can be used to ship many non-volatile liquids as well as industrial powders.

Drums may have one or more openings, for example, two openings with flanges (2" NPS and ¾" NPS). Once the drums are filled, the plugs (bungs) may be screwed in the flanges using pneumatic or hand operated bung tightener (plug wrench). To secure the contents of the drums against theft and adulteration during shipment, cap-seals made of metal and other types like metal and plastic may be used. These cap-seals sit on top of the flanges and are 'crimped' using drum cap-seal crimping tools (also called drum cap sealers). Once cap-seals are crimped, the plugs can be unscrewed only by breaking these cap-seals.

In an implementation, a 55-gallon drum in the United States (known as a 200-liter drum internationally and a 44-gallon drum in the United Kingdom) may be a cylindrical container with different capacities. For example, a container may have a nominal capacity of 55 U.S. gallons (200 liters or 44 imp gal). The exact capacity of the container may vary by manufacturer, purpose, or other factors. Standard drums have inside dimensions of about 22.5 inches (572 mm) diameter and about 33.5 inches (851 mm) height. These dimensions yield a volume of about 13,320 cubic inches (6.19 bushels) or 57.66 U.S. gallons (48.0 imp gal; 218.3 L), but they are commonly filled to about 200 liters.

It will be appreciated that the outside dimensions of a standard drum (55 U.S. gallons, 200-liter, or 44 imp gal) are typically about 23 inches (584 mm) diameter at the top or bottom rim, about 23.5 inches (597 mm) diameter at the chimes (ridges around drum), and about 34.5 inches (876 mm) height.

Referring to FIGS. 1-2, it will be appreciated that the device, system and method 100 may further comprise a stand 120. The stand may comprise a base portion 122 and an upright portion 124. The device, system and method 100 may further comprise a first support structure 122*a* and a second support structure 122*b*. The base portion 122 may be attached to the first support structure 122*a* and the second support structure in a substantially perpendicular manner or normal to the first and second support structures 122*a* and 122*b*. The upright portion 124 may extend vertically upward from the base portion 122 as illustrated in FIGS. 1 and 2. The upright portion 124 may be configured to receive and support a first container 110, such as a drum. The first container 110 may be rotatably attached to the stand 120 with an axle 114 so as to allow the container 110 to rotate relative to the stand 120. The upright portion 124 may be sized, configured and dimensioned so as to allow the first container 110 to be rotated above the base portion 122. It will be appreciated that in some implementations the upright portions of the stand may be adjustable to accommodate differing mixing containers. The upright portion 124 may be sized, configured and dimensioned to allow the first container 110 to be emptied into another, second container 130 as illustrated in FIG. 2.

It will be appreciated that the relative sizing and dimensions of the stand 120, including the base portion 122 and the upright portion 124, with respect to the first container 110 may be such that the contents of the first container 110 may be completely emptied into one or more second containers 130. In an implementation, the stand 120 may be sized relative to the second containers 130 being filled such that the mixing container 110 may be substantially emptied into the secondary containers 130.

It will be appreciated that in an implementation, the second container 130 may be larger than the first container 110. In an implementation, the second container 130 may be substantially the same size as the first container 110. In an implementation, the second container 130 may be smaller than the first container 110, such that the first container 110 may empty its contents into one or more, i.e., a plurality of, second containers 130. The relative sizing between the first container 110 and the second container 130 may be such that the contents of the first container 110 may be completely emptied into one or more second containers 130.

In an implementation, illustrated best in FIG. 1, the device, system and method 100 may further comprise a handle 116 that may be in mechanical communication with the axle 114 so as to allow a user to rotate the first container 110 by actuating the handle 116. In an implementation, the handle 116 may be configured to position the container 110 for pouring out its contents. In an implementation, the handle 116 may be configured to position the container 110 for being filled with topping components.

In an implementation, the container 110 may be cylindrical. In an implementation, the container 110 may rotate concentric to a centerline of the cylindrical container. In an implementation, the container 110 may be attached to the base portion 122 at a midpoint of an outer surface. In an implementation, the container 110 may be configured to be rotated end over end about its midpoint.

In an implementation, illustrated best in FIG. 3, the upright portion 124 may comprise two vertical members 124*a* and 124*b* that extend up from opposing ends of the base portion 122. In an implementation, the device, system and method 100 may comprise a bracket member 140 for attaching or connecting the first container 110 to the stand 120. The bracket member 140 may comprise two structural members 142*a* and 142*b* that may be connected by a first cross bar 144*a* on the top of the container 110 and a second cross bar 144*b* on the bottom of the container 110 (illustrated best in FIGS. 1-2). The bracket member 140 may be sized and shaped to work with various mixing containers of differing dimensions.

In an implementation the bracket member 140 may be configured to release a mixing container, and then accept a different mixing container.

In an implementation, the device, system and method 100 may further comprise a spout or a bulkhead fitting with a spout 112 (illustrated best in FIGS. 2 and 3). The spout 112 may be disposed at an end, such as a top end, of the container for emptying the contents of the container after mixing. The spout 112 may comprise a valve 113 for opening and closing to thereby allow or stop the fluid flow, such that fluid may be poured into the second container 130. In an implementation, the device, system and method 100 may further comprise an opening 118 at an end of the container 110 for adding fluid, such as topping components, into the container 110 for mixing.

In an implementation, the device, system and method 100 may comprise a motor 150 (illustrated best in FIGS. 3 and 5 as 555), such as an electric motor, that may be configured to rotate the container 110 by way of axle 114. FIG. 3 further illustrates a system comprising a secondary container 130, or plurality of secondary containers for receiving mixed fluids and/or other fluids from the mixing container 110. The system may comprise spouts 112 configured to specifically fit an opening in the secondary container 130 in order to provide rapid transfer with minimal spillage. Accordingly, an exemplary system may comprise mixer, a dedicated spout, and dedicated secondary containers.

Figure 4:
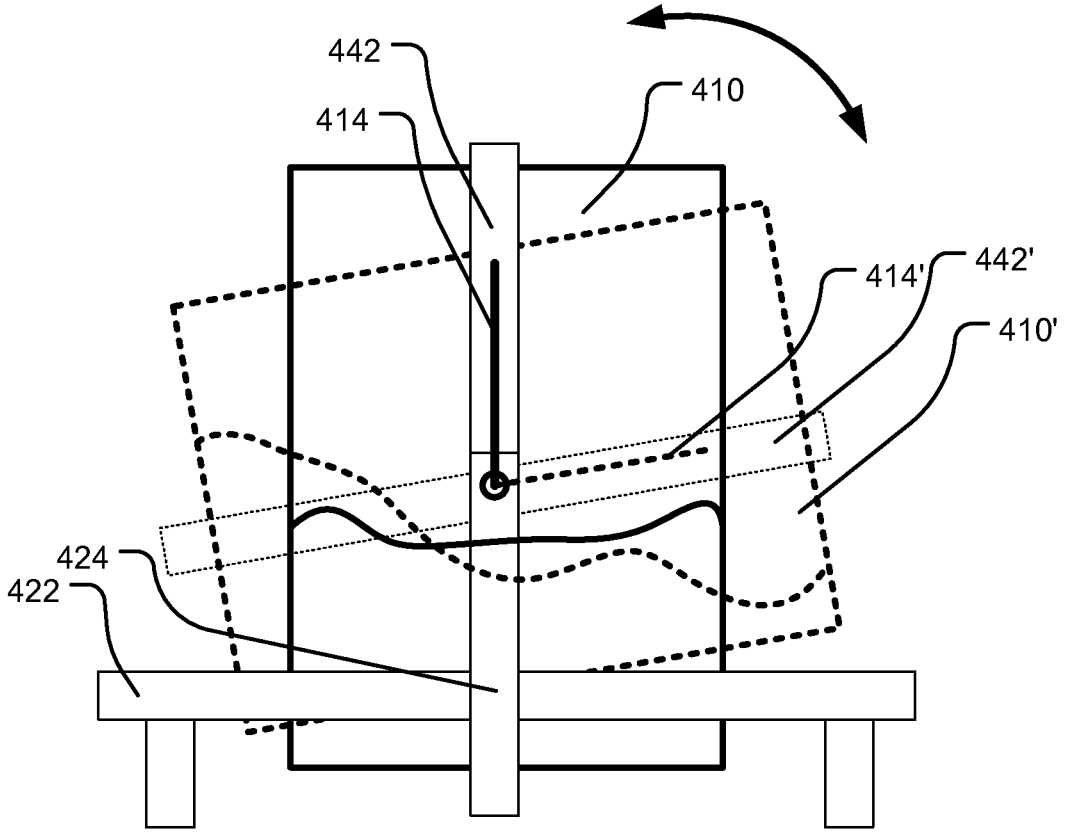
FIG. 4 illustrates a mixing device, system and method for mixing a fluid within a rotating container according to the teachings and principles of the disclosure.

FIG. 4 illustrates a mixer 400 that is being rotated end over end during mixing. As can be seen in the figure a mixing container 410 may be rotated within a bracket 442 relative to base 422. Leverage for turning the mixing container 410 may provide with handle 414. As illustrated in the figure, as handle 414 is rotated to 414' (shown in dashed lines), bracket 442 and mixing container 410 are rotated to bracket 442' (shown in dashed lines) and mixing container 410' (shown in dashed lines), thereby mixing the fluids contained in the mixing container 410.

Figure 5:
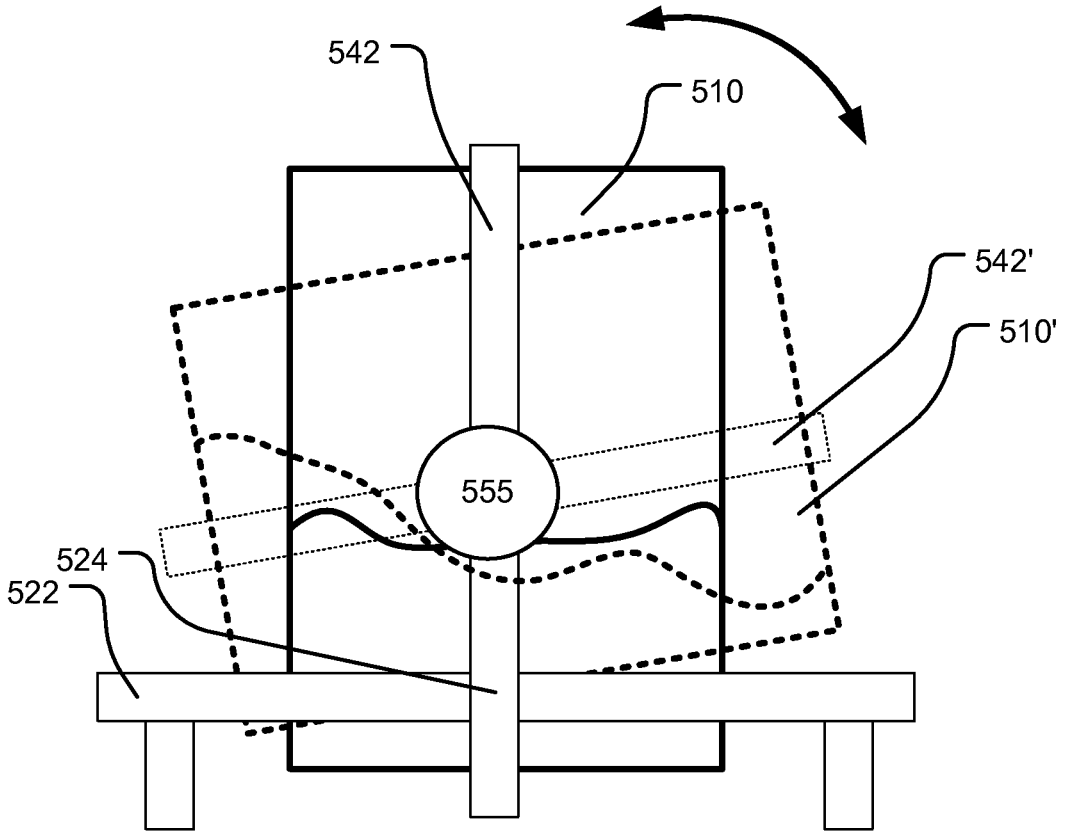
FIG. 5 illustrates a mixing device, system and method for motorized mixing of a fluid according to the teachings and principles of the disclosure.

FIG. 5 illustrates a mixer 500 that is being rotated end over end during mixing. As can be seen in the figure, a mixing container 510 may be rotated within a bracket 542 relative to base 522. Power for turning the mixing container 510 may be provided by a motor 555. As illustrated in the figure, as motor 555 rotates, bracket 542 and mixing container 510 are rotated to bracket 542' (shown in dashed lines) and mixing container 510' (shown in dashed lines), thereby mixing the fluids contained in the mixing container 510.

Figure 6:
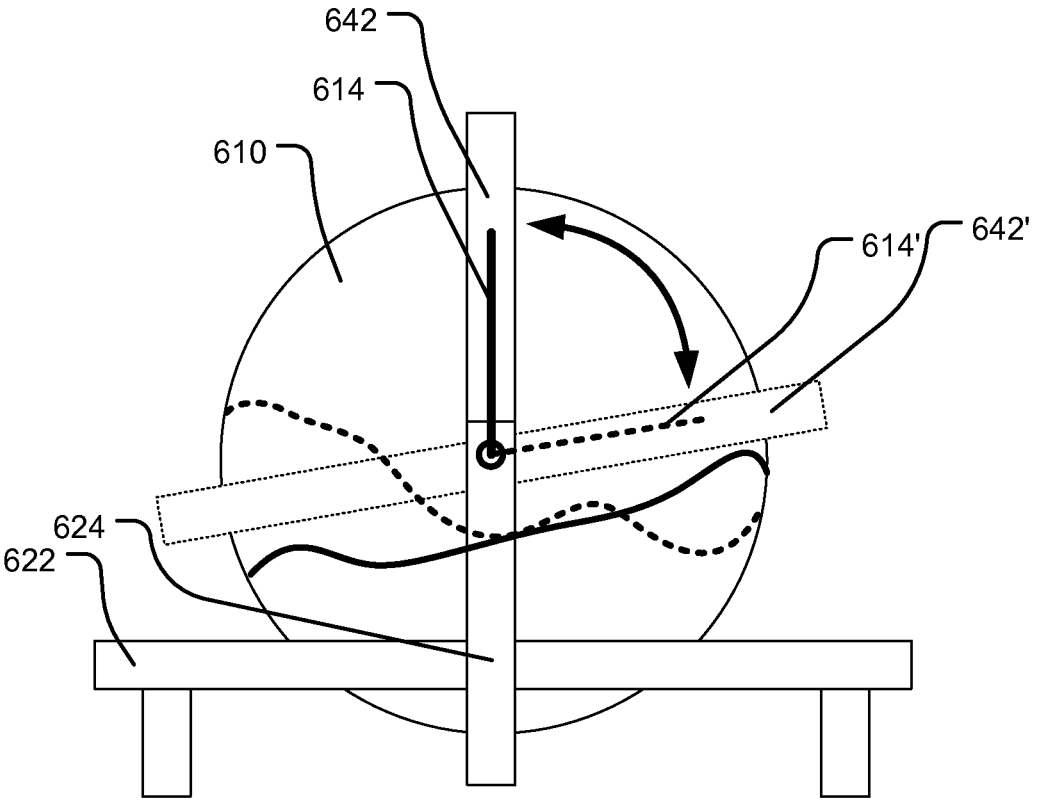
FIG. 6 illustrates a mixing device, system and method wherein a cylindrical container rotates about its centerline.

FIG. 6 illustrates an implementation wherein the mixing container 610 rotates about its cylindrical center line. As shown in the figure a mixing container 610 may be rotated within a bracket 642 relative to base 622. Leverage for turning the mixing container 610 may provide with handle 614. As illustrated in the figure, as handle 614 is rotated to 614' (shown in dashed lines), bracket 642 and mixing container 610 are rotated coaxially to bracket 642' (shown in dashed lines) and mixing container 610' (shown in dashed lines), thereby mixing the fluids contained in the mixing container 610.

It will be appreciated that the following are exemplary implementations of the disclosure. In an implementation of a mixer for mixing a fluid, such as a confectionary topping, and dispensing the fluid into another container may comprise a first container configured to receive a fluid, such as confectionary topping components, to be mixed. The implementation may further comprise a stand having a base portion and an upright portion wherein said upright portion extends vertically up from said base portion and wherein said upright portion is configured to receive and support the first container. The implementation may further be configured wherein the first container is rotatably attached to the stand with an axle so as to allow the first container to rotate relative to the stand. Additionally, the stand may be configured wherein the upright portion is sized so as to allow the first container to be rotated above the base portion and wherein the upright portion is sized to allow the contents of the first container to be emptied into one or more second containers.

In an implementation of a mixer, the mixer may further comprise a handle in mechanical communication with said axle so as to allow a user to rotate said first container by actuating said handle. The mixer may be configured wherein the first container is cylindrical and attaches to the base at a midpoint of an outer surface. An implementation of a mixer may comprise a first container that is configured to be rotated end over end about its midpoint. A further implementation of a mixer may further comprise an upright portion that comprises two vertical members that extend up from opposing ends of said base portion. The implementation of a mixer may further comprise a bracket, wherein the bracket comprises two structural members are connected by at least one cross bar.

In an implementation the first container may be a cylindrical container wherein the container rotates concentric to a centerline of the cylindrical container.

In an implementation of a system the mixer may further comprise a spout disposed at an end of the mixing/first container for emptying the contents of said first container after mixing. Additionally, a mixer may further comprise an opening at an end of the first container for adding fluid, such as topping components, into said first container for mixing. A mixer may further be configured wherein the handle is configured to position said first container for pouring out its contents.

In an implementation of a mixer a handle may be configured to position said first container for being filled with topping components and wherein the first container is configured to be rotated by an electric motor.

In an implementation of a mixer system the stand may be sized relative to containers being filled to better provide for completely emptying the first/mixing container.

The foregoing description has been presented for the purposes of illustration and description. It is not intended to be exhaustive or to limit the disclosure to the precise form disclosed. Many modifications and variations are possible in light of the above teaching. Further, it should be noted that any or all of the aforementioned alternate implementations may be used in any combination desired to form additional hybrid implementations of the disclosure.

Further, although specific implementations of the disclosure have been described and illustrated, the disclosure is not to be limited to the specific forms or arrangements of parts so described and illustrated. The scope of the disclosure is to be defined by the claims that may be appended hereto, any future claims submitted here and in different applications, and their equivalents.

What is claimed is:

1. A mixer for mixing a fluid-and for dispensing the fluid into another container comprising:

a cylindrical drum configured to receive and hold a fluid that is to be mixed, wherein the cylindrical drum comprises a base and an upper lid each having a substantially flat shape, the upper lid including a first opening, and a second opening;

a stand comprising a base portion and an upright portion;

wherein said upright portion of said stand extends vertically up from said base portion;

a bracket configured to receive and support the cylindrical drum, the bracket comprising two structural members connected by a first cross bar configured to be disposed across the upper lid of the cylindrical drum and a second cross bar configured to be disposed across the base of the cylindrical drum, wherein tension is applied between the first cross bar and the second cross bar to the cylindrical drum to secure the cylindrical drum to the bracket, wherein the first cross bar is a flat rectangular bar that extends across the cylindrical drum and contacts the cylindrical drum only on the rim of the cylindrical drum, wherein the first cross bar is disposed between the first opening and the second opening on the cylindrical drum, and wherein each of the two structural members has a length substantially equal to a length of the cylindrical drum and each of the two structural members are positioned along the length of the cylindrical drum; and wherein the bracket is rotatably attached to the stand via an axle so as to allow the cylindrical drum to rotate relative to the stand; and wherein the upright portion is sized so as to allow the cylindrical drum to be rotated above the base portion and wherein the upright portion is sized to allow the contents of the cylindrical drum to be emptied into one or more second containers.

2. The mixer of claim 1, further comprising a handle that is in mechanical communication with said axle so as to allow a user to rotate said cylindrical drum by actuating said handle.

3. The mixer of claim 2, wherein the handle allows the cylindrical drum to be tilted so as to empty its contents out of the first opening by a spout, including a valve.

4. The mixer of claim 1, wherein the cylindrical drum attaches to the base portion at a midpoint of an outer surface of the cylindrical drum.

5. The mixer of claim 1, wherein the cylindrical drum is configured to be rotated end over end about its midpoint.

6. The mixer of claim 1, wherein the upright portion comprises two vertical members that extend up from opposing ends of said base portion.

7. The mixer of claim 1, wherein the cylindrical drum rotates about a centerline of the cylindrical drum.

8. The mixer of claim 1, further comprising a spout disposed at the upper lid of said cylindrical drum for emptying the contents of said cylindrical drum after mixing.

9. The mixer of claim 1, wherein the second opening is positioned on the upper lid of said cylindrical drum for adding fluid into said cylindrical drum for mixing.

10. The mixer of claim 2, wherein the handle is configured to position said cylindrical drum for pouring out its contents.

11. The mixer of claim 2, wherein the handle is configured to position said cylindrical drum for being filled with topping components.

12. The mixer of claim 1, wherein the cylindrical drum is configured to be rotated by an electric motor.

13. The mixer of claim 1, wherein the stand is sized relative to containers being filled.

14. A system for mixing fluids in a container and dispensing mixed fluids into secondary containers, the system comprising:

a cylindrical drum configured to receive and hold a fluid for mixing, wherein the cylindrical drum comprises a base and an upper lid each having a substantially flat shape, the upper lid including a first opening, and a second opening;

a second container configured for receiving mixed fluid from the cylindrical drum;

a mixer for mixing a fluid and for dispensing the fluid into the second container comprising:

a stand comprising a base portion and an upright portion;

wherein said upright portion extends vertically up from said base portion;

a bracket configured to receive and support the cylindrical drum, the bracket comprising two structural members connected by a first cross bar configured to be disposed across the upper lid of the cylindrical drum and a second cross bar configured to be disposed across the base of the cylindrical drum, wherein the cylindrical drum is secured to the bracket by the first cross bar and the second cross bar;

wherein the first cross bar is a flat rectangular bar which extends across the cylindrical drum and contacts the cylindrical drum only on the rim of the cylindrical drum, wherein the first cross bar is disposed between the first opening and the second opening on the cylindrical drum;

wherein each of the two structural members has a length substantially equal to a length of the cylindrical drum and each of the two structural members are positioned along the length of the cylindrical drum;

wherein the bracket is rotatably attached to the stand via an axle so as to allow the cylindrical drum to rotate relative to the stand; and wherein the upright portion is sized so as to allow the cylindrical drum to be rotated above the base portion and wherein the upright portion is sized to allow the contents of the cylindrical drum to be emptied into the second container.

15. The system of claim 14, further comprising a plurality of second containers.

16. The system of claim 14, further comprising a spout configured to be attached to the cylindrical drum and that is sized and shaped to the first opening in the second container.

17. The system of claim 14, further comprising a motor in mechanical communication with the axle for rotating the cylindrical drum.

18. The system of claim 14, further comprising a hand crank in mechanical communication with the axle for rotating the cylindrical drum.

19. The system of claim 14, further comprising a plurality of premeasured ingredients for mixing in the cylindrical drum.

20. The system of claim 14, wherein the second opening in the upper lid is configured for receiving ingredients for mixing.

21. The system of claim 14, further comprising rollers attached to the stand allowing the stand to be moved.

* * * * *